US005960480A

United States Patent [19]

Neustater et al.

[11] Patent Number: 5,960,480

[45] Date of Patent: Oct. 5, 1999

[54] FALL PROTECTION SAFETY SUIT

[75] Inventors: Craig W. Neustater, New Brunswick, N.J.; Henry Dowding, Staten Island, N.Y.; Patrick A. Dowson, Cromwell, Conn.

[73] Assignee: Otis Elevator Company, Farmington, Conn.

[21] Appl. No.: 08/451,281

[22] Filed: May 26, 1995

[51] Int. Cl.[6] ..... A62B 35/04

[52] U.S. Cl. ..... 2/456; 182/3

[58] Field of Search ..... 2/69, 310, 309, 2/311–318, 327, 338, 94, 2, 455, 456; 182/3–7, 129; 244/151 R, 143

[56] References Cited

U.S. PATENT DOCUMENTS

| | | | |
|---|---|---|---|
| 2,979,153 | 1/1961 | Hoagland et al. | 182/3 |
| 3,176,793 | 4/1965 | Hlacia | 182/3 |
| 3,424,134 | 1/1969 | Rosenblum | 182/3 |
| 3,559,932 | 2/1971 | Ternes | 244/151 R |
| 4,076,101 | 2/1978 | Himmelrich | 182/3 |
| 4,177,877 | 12/1979 | Gallinati | 182/3 |
| 4,273,216 | 6/1981 | Weissman | 182/3 |
| 4,618,026 | 10/1986 | Olson | 182/4 |
| 4,625,335 | 12/1986 | Vinai | 2/69 |
| 4,682,671 | 7/1987 | Hengstenberger et al. | 182/3 |
| 4,731,882 | 3/1988 | Ekman | 244/143 X |
| 4,854,418 | 8/1989 | Hengstenberger et al. | 182/3 |
| 5,036,548 | 8/1991 | Grilliot et al. | 2/81 |
| 5,090,503 | 2/1992 | Bell | 182/5 |
| 5,136,724 | 8/1992 | Grilliot et al. | 2/81 |
| 5,329,884 | 7/1994 | Bell | 182/3 X |

*Primary Examiner*—Peter Nerbun

[57] ABSTRACT

A fall-protection safety suit is provided having a coverall with legs, arms and torso sections and a strap assembly mounted within the coverall and having a connection portion for interconnection to an anchorage. The strap assembly is configured for automatic adjustment from a first loose fitting position about a wearer to a second fall-protect position about the wearer responsive to a fall-arresting force. The strap assembly in the second position is tight fitting about the wearer and positioned to distribute fall-arresting forces to pre-selected body portions of the wearer to minimize injury. The strap assembly is configured for distributing fall-arresting forces to predetermined portions of a wearer's body. The strap assembly may connect to a shock absorber via a connector portion positioned at the outer surface of the coverall approximately mid-back between shoulder blades of a wearer. The shock absorber is adapted for interconnection to an anchorage. The coverall has a pocket on its outer surface at approximately lower mid-back of a wearer for housing the shock absorber.

16 Claims, 4 Drawing Sheets

10
14
130
12
82
36
28
110
106
32
16
24
22
128
23
26
40
126
38
38
40
42
48
50
40
52
38
44
46
34
30
20
18

FALL PROTECTION SAFETY SUIT

TECHNICAL FIELD

This invention relates to safety equipment for protection against falls and more particularly to a fall protection safety suit.

BACKGROUND OF THE INVENTION

Governmental regulations and company policies often require certain types of workers to wear fall protection equipment while working at heights.

Various types of safety equipment have been proposed for fall protection. Body belts and body harnesses are two common types of fall protection equipment. Body harnesses are utilized where vertical free fall hazards exist as body harnesses distribute the fall-arresting forces throughout a larger area of the body as compared to a body belt.

Both body belts and full body harnesses must be worn snugly around the body. Generally, a body harness includes straps that snugly encircle each upper thigh and straps that extend from below the waist area, up along the chest, and over the shoulder and down the back of the wearer in a predetermined pattern. The leg straps, the vertically extending chest and back straps, and any waist or lateral chest straps are manually adjustable by buckles or the like to achieve proper positioning and snug fitting to the wearer. Body harnesses are worn over the wearer's clothes or coveralls.

Body harnesses may be difficult to put on and may be uncomfortable to wear for extended periods due to the tight fitting nature and strap configuration. Body harnesses are also not esthetically pleasing being worn over the worker's clothing. For these and other reasons, some workers are resistant to wearing a harness during the entire period required. Indeed, some companies have experienced significant difficulties in achieving full compliance with body harness use requirements.

There have been attempts to incorporate a body harness in a coverall or other garment, but the resulting combination has exhibited many of the short comings of the body harness per se. Notably, the body harness in a coverall is similarly tight fitting so as to be uncomfortable and cumbersome to work in.

Accordingly, it would be desirable to achieve a fall protection safety suit that is convenient and comfortable to work in so that workers would not resist wearing such a suit during the entire work day.

DISCLOSURE OF THE INVENTION

It is an object of the present invention to provide a new and improved safety suit which provides fall protection for vertical free fall hazards.

Another object of the invention is to provide a fall-protection safety suit which is comfortable and relatively loose to wear and self-adjusting upon the occurrence of a fall to distribute fall-arresting forces to predetermined parts of the body.

A further object of the invention is to provide such a safety suit which is self-adjusting so as to fit the wearer safely and correctly all the time without wearer adjustment.

A further object of the invention is to provide such a safety suit which is lightweight and minimizes or eliminates buckles, hardware, and exterior strapping for both safety and comfort.

A further object of the invention is to provide such a safety suit which is durable in use and refined in appearance.

A further object of the invention is to provide a new and improved method of assembly of such a fall-protection safety suit.

Other objects will be in part obvious and in part pointed out in more detail hereinafter.

Accordingly, it has been found that the foregoing and related objects are attained and disadvantages of the prior art are overcome in a fall-protection safety suit having a coverall with legs, arms and torso sections and a strap assembly mounted within the coverall and having a connection portion for interconnection to an anchorage. The strap assembly is configured for automatic adjustment from a first loose fitting position about a wearer to a second fall-protect position about the wearer responsive to fall-arresting force. The strap assembly in the second position is tight fitting about the wearer and positioned to distribute fall-arresting forces to pre-selected body portions of the wearer to prevent injury.

In another embodiment of the present invention, a fall protection safety suit has a coverall with legs, arms and torso sections and an inner and outer surface, and a strap assembly mounted within the coverall and configured for distributing fall-arresting forces to predetermined portions of a wearer's body. The strap assembly has a connector portion for connection to a shock absorber and the connector portion is positioned at the outer surface of the coverall approximately mid-back between shoulder blades of a wearer. An elongated shock absorber is connected to the connector portion of the strap assembly and adapted for interconnection to an anchorage. The coverall has an elongated pocket on its outer surface for housing the shock absorber and positioned at approximately lower mid-back of a wearer.

BEST MODE FOR CARRYING OUT THE INVENTION

Figure 1:
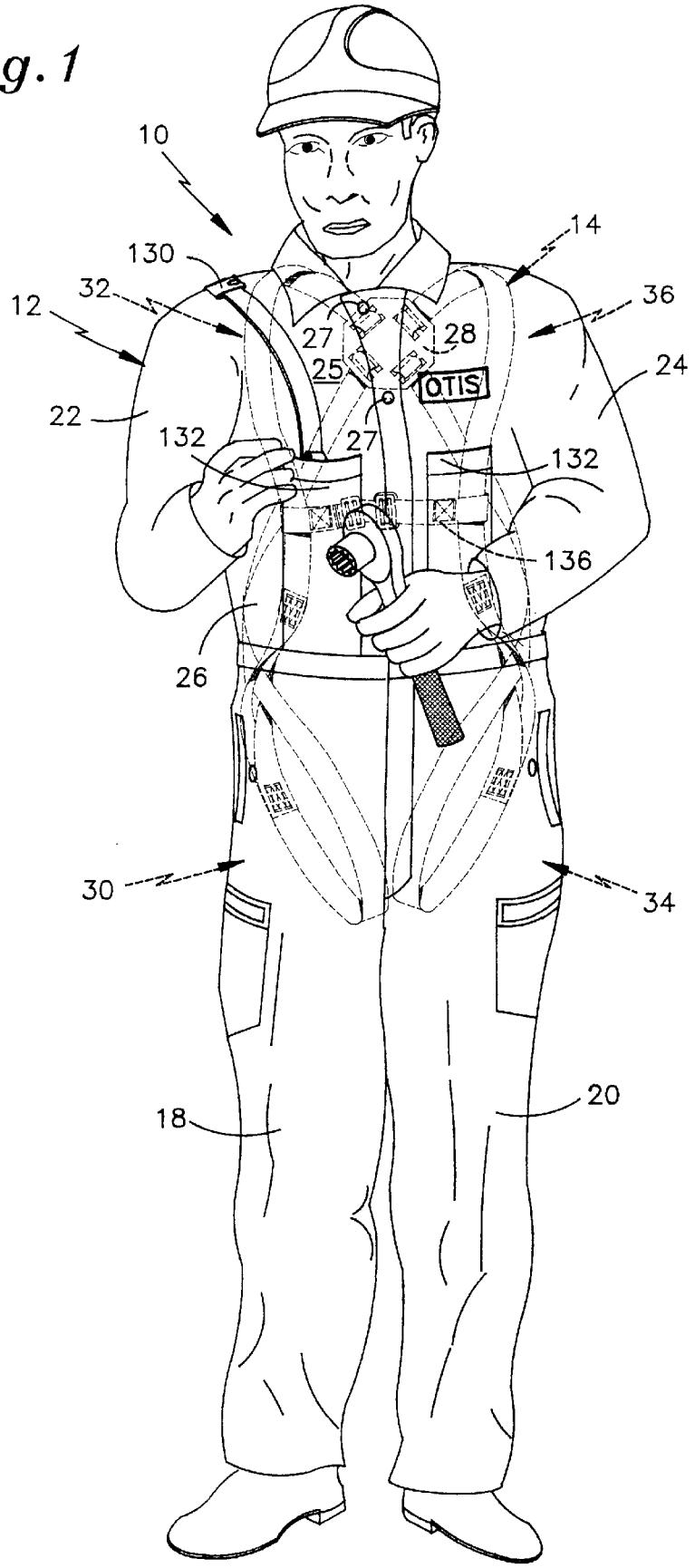
FIG. 1 is a diagrammatic front view of a worker wearing the safety suit of the present invention.

Although specific forms of the present invention have been selected for illustration in the drawings, the following description is drawn in specific terms for the purpose of describing these forms of the invention, the description is not intended to limit the scope of the invention which is defined in the appended claims.

Figure 2:
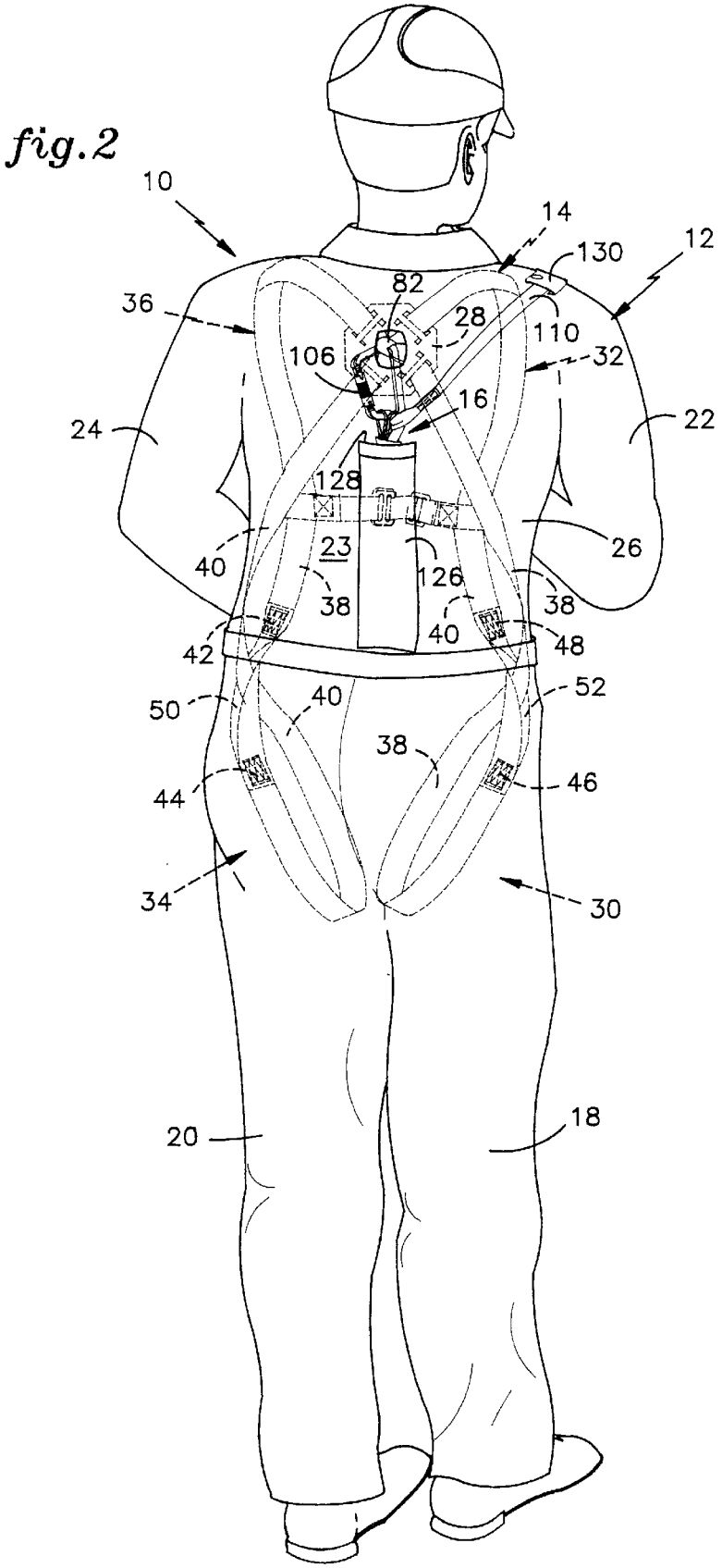
FIG. 2 is a rear view similar to FIG. 1.

Referring initially to FIGS. 1 and 2, the safety suit of the present invention generally comprises a coverall garment 12, a strap assembly 14 (shown in broken line) and a shock absorber assembly 16 (FIG. 2).

The coverall garment 12 has leg sections 18, 20, arm sections 22, 24, and torso section 26 and has a vertical opening in the front closed by snaps 27 and a zipper (not shown) for putting on and removing the garment. The coverall garment 12 is intended to be worn over work clothes as a conventional coverall.

The strap assembly 14 has a back pad 28 and a strap configuration that forms four (4) loop sections 30, 32, 34, 36. Loop section 30 encircles the right thigh and pelvis of the wearer and loop section 32 extends from back pad 28 at the mid-back between the shoulder blades of the wearer up over the right shoulder and vertically down along the chest and mid-section to loop section 30 and upwardly from loop section 30 along the back of the wearer to back pad 28 as best shown in FIG. 2. Similarly, loop section 34 encircles the upper left thigh and pelvis of the wearer and loop section 36 extends from back pad 28 over the left shoulder of the wearer and vertically down along the chest and mid-section to loop section 34 and from loop section 34 along the back of the wearer to back pad 28 as best shown in FIG. 2.

The loop sections 30, 32, 34, 36 are formed by two (2) pieces of strap material 38, 40. In the illustrated embodiment, strap 38 is a single piece of webbing or strap material and strap 40 is similarly a single piece of strap material. Alternately, straps 38, 40 can be constructed from a plurality of strap segments sewn or otherwise jointed together.

The straps 38, 40 are sewn together at stitch areas 42, 44, 46, 48. Stitch areas 42, 44 are spaced apart to form a slot 50 between the joined straps 38, 40 such that strap 40 extends through slot 50 to form loop section 34. Similarly, stitch areas 46, 48 are spaced apart to form a slot 52 between the joined straps 38, 40 so that strap 38 extends through slot 52 to form loop section 30. Strap 38 slides easily through slot 52 to permit tightening and loosening of loop section 30. Strap 40 slides easily through slot 50 to permit tightening and loosening of loop section 34.

Figures 3, 4, 6:
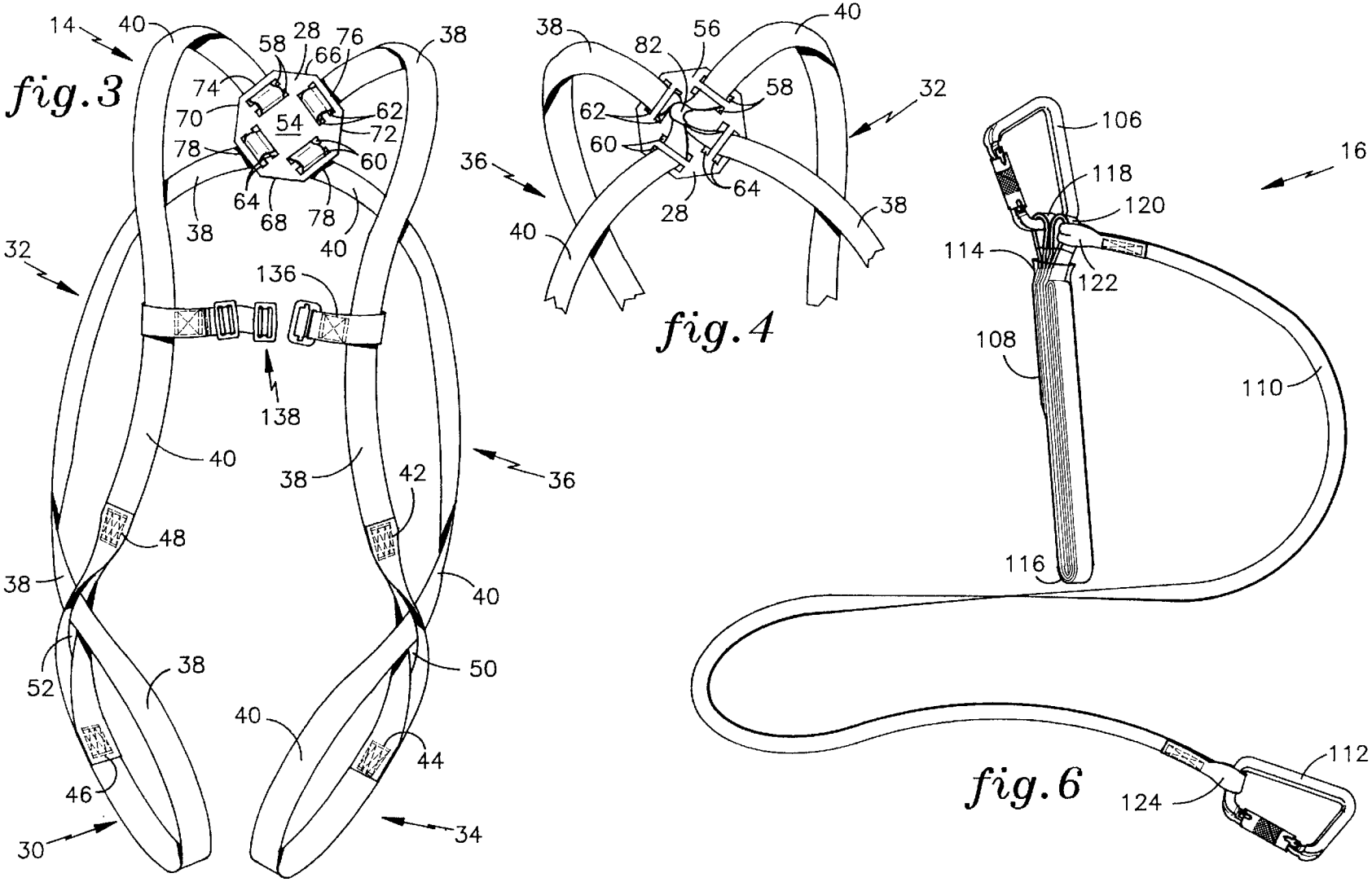
FIG. 3 is an enlarged perspective view of the strap assembly shown in FIGS. 1 and 2.
FIG. 4 is a broken away view of the underside of the back pad as shown in FIG. 3.
FIG. 6 is a perspective view of the shock absorber assembly.

The back pad 28 is octagon shaped with an inner surface 54 disposed toward the back of the wearer and an outer surface 56 disposed outwardly from the back of the wearer. Referring particularly to FIG. 4, the strap 40, extending from loop section 32, passes through four (4) slots in back pad 28 and then extends from back pad 28 to form loop section 36. Specifically, the strap 40 from loop section 32 passes through two (2) upper slots 58 in back pad 28, across the outer surface 56, and through two (2) lower slots 60 into loop section 36. Similarly, the strap 38 extends from loop section 36 through two (2) upper slots 62 in pad 28, across surface 56 and through to lower slots 64 into loop section 32.

When the coverall 12 is being worn, the back pad 28 is positioned such that the upper edge 66 and lower edge 68 are horizontal and opposed side edges 70, 72 are vertical. The upper slots 58 are adjacent to (and approximately parallel) to upper edge 74. Upper slots 62 are adjacent (and approximately parallel) to upper edge 76. The lower slots 60 are adjacent (and approximately parallel) to lower edge 78. The lower slots 64 are adjacent (and approximately parallel) to lower edge 78.

Referring to FIG. 4, the straps 38, 40 are encircled by a plastic tube section 82 at approximately the center of pad 28 to form a loop or connector portion for connecting to the shock absorber assembly 16. The upper slots 58 and the lower slots 60 are appropriately dimensioned relative to strap 40 to allow strap 40 to freely slide through the slots 58, 60 when a pulling force is applied to the loop 82. Similarly, the upper slots 62 and the lower slots 64 are dimensioned relative to strap 38 to allow strap 38 to also freely slide through the slots 62, 64 when a pulling force is applied to loop 82. The ease of movement of the straps 38, 40 through the respective slots contributes to achieving the self adjusting feature of the strap assembly 14. The back pad 28 is made of nylon impregnated with neoprene and is soft and pliable to facilitate the free slip of the straps through the respective slots and for comfort against the back of the wearer. The crossing pattern of the straps 38, 40 allows the pad 28 to lay flat on the back of the wearer for comfort.

The straps 38, 40 are secured to the coverall garment 12 by a plurality of sleeves or cloth tubes sewn to the inner surface or lining of the coverall garment. As will be explained, it is important to the effective operation of the safety suit that the strap assembly 14 be maintained in approximately a predetermined position relative to the body of the wearer.

Figure 5:
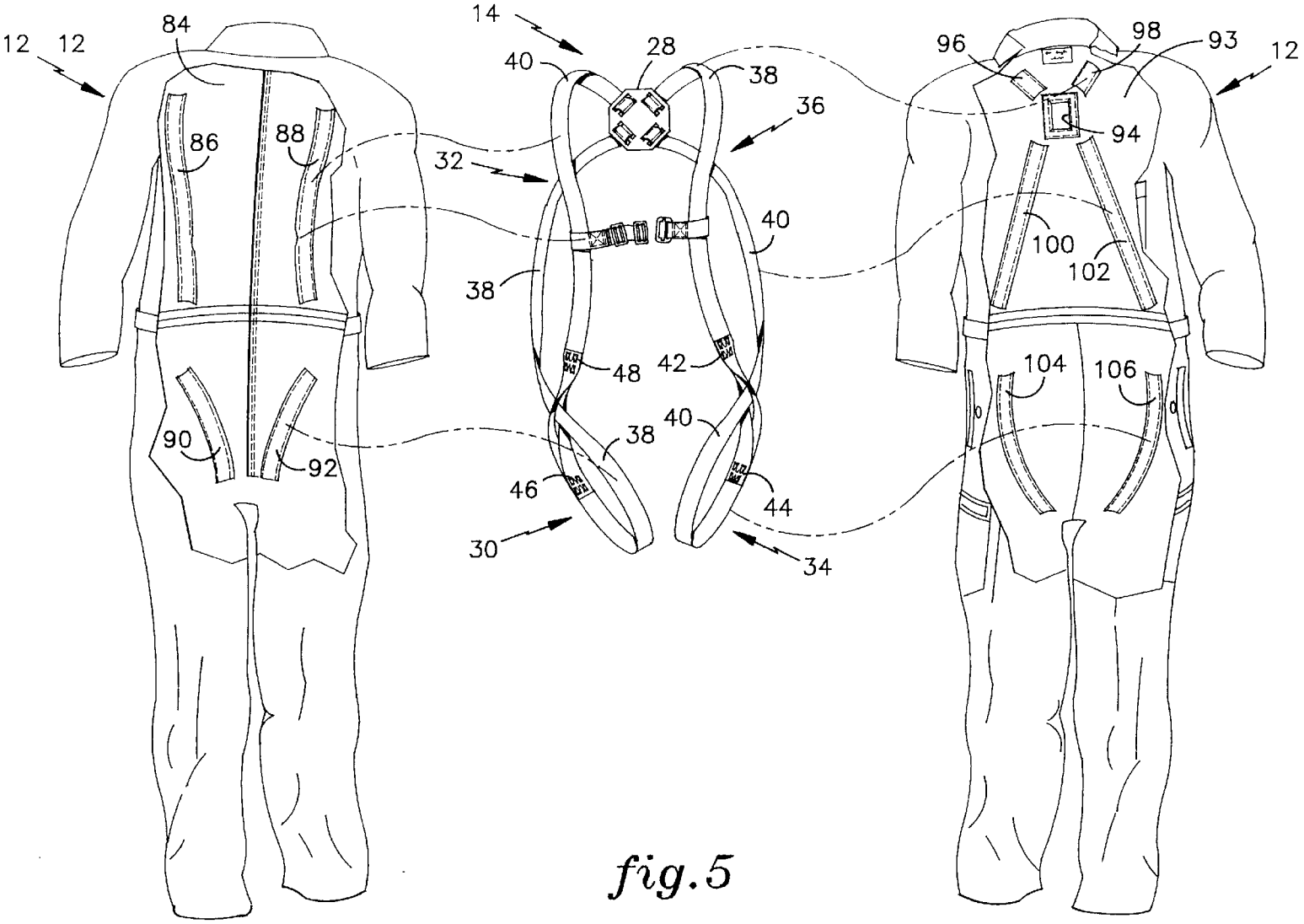
FIG. 5 is a partly broken away diagrammatic view of the mounting of the strap assembly in the front and rear interior lining of the coverall.

Referring to FIG. 5 (left side), the front inner surface 84 of coverall 12 has a sleeve section 86 extending vertically from the left shoulder to the waist and a sleeve section 88 extending vertically from the right shoulder to the waist. A sleeve section 90 extends downwardly from the waist around the left thigh and a sleeve section 92 extends downwardly from the waist around the right thigh.

Referring to FIG. 5 (right side), the rear inner surface 93 has an aperture 94 to allow the loop 82 of strap assembly 14 to extend outwardly through the coverall garment 12. A sleeve section 96 extends from the aperture 94 toward the right shoulder and a sleeve section 98 extends from the aperture 94 to the left shoulder. A sleeve section 100 extends downwardly from the aperture 94 to the right side of the waist and similarly, a sleeve section 102 extends downwardly from the aperture 94 to the left side of the waist. A sleeve section 104 extends downwardly from the waist about the right thigh and a corresponding sleeve section 106 extends downwardly from the waist about the left thigh.

The strap 40 of loop section 32 extends through sleeve section 88 and the strap 38 of loop section 36 extends through sleeve 86. The strap 38 of loop section 30 extends through sleeve section 92 and the strap 40 of loop section 34 extends through sleeve section 90.

Referring to FIG. 5 (right side), the strap 38 of loop section 36 extends through sleeve section 98 and the strap 40 of loop section 36 extends through sleeve section 102. The strap 40 of loop section 32 extends through sleeve section 96 and the strap 38 of loop section 32 extends through sleeve section 100. The strap 40 of loop section 34 extends through sleeve section 106. The strap 38 of loop section 30 extends through sleeve section 104.

Referring back to FIGS. 1 and 2, the strap assembly 14 is configured to distribute fall-arresting forces to appropriate parts of the wearer's body when the strap assembly is snugly fitted to the body as a result of fall-arresting force applied to loop 82. The upper thighs and pelvis are particularly strong parts of the body for withstanding fall-arresting force having large bones and soft tissue areas. The criss-cross pattern of the straps on the back and the strap path over the shoulder and down along the chest and mid-section on both sides of the body also distribute the fall-arresting forces to these strong areas of the body. The sleeve sections 86–104 are dimensioned relative to the straps 38, 40 to allow the straps to move through the sleeve sections during automatic adjustment from the loose-fitting position to the tight-fitting position as described hereinafter.

The strap assembly 14 has only four (4) stitch areas which reduces the opportunity for degradation of the strap assembly. The configuration of the sleeve sections permits easy inspection of the stitch patterns for degradation during the useful life of the safety suit as the respective strap 38 or 40 may be moved slightly to remove each stitch area from a covering sleeve for inspection. Specifically, the strap 40 is easily drawn so that the stitch pattern 48 can be inspected below sleeve section 88 and the stitch area 44 can be inspected above sleeve section 106. Similarly, the strap 38 can be moved so that stitch area 42 is inspected below sleeve section 86 and stitch area 46 is inspected above sleeve section 104. The sleeve sections 86–104 are positioned on the respective inner surfaces 84, 93 so as to avoid crossing a seam of the coverall garment 12 for economy of manufacture and durability as explained in more detail hereinafter.

Referring to FIG. 2, the loop 82 is positioned at the outer surface of the coverall approximately mid-back between shoulder blades of the wearer as required by OSHA. The shock absorber assembly is connected to the loop 82. Referring to FIG. 6, the shock absorber assembly comprises a locking karabiner 106, shock absorber 108, lanyard 110 and another locking karabiner 112. Shock absorbers or energy absorbers as used with body belts and body harnesses are generally known and therefore shock absorber 108 need not be described in detail for purposes of the present invention. The shock absorber 108 has an upper end 114 and a lower end 116. The upper end 114 has a connector loop 118 for connection to the karabiner 106 and a connector loop 120 for the connection to the end 122 of the lanyard 110. Thus, both connector loops 118, 120 are positioned at one end of the shock absorber. The other end 124 of lanyard 110 is connected to the karabiner 112.

The outer surface 23 of the back of garment 12 has an elongated pocket 126 positioned at mid-back of the wearer and extending from the waist upwardly to the mid-back below the shoulder blades as seen in FIG. 2. The pocket 126 has an upper opening and is dimensioned to house the shock absorber 108 such that the connector loops 118, 120 extend outwardly from the opening 128 of the pocket 126. The karabiner 106 is connected through the loop 82 and locked to secure the loop 82 of the shock absorber assembly 16 to the loop 118 of the shock absorber 108.

The lanyard 110 extends from the connector loop 120 diagonally upwardly across the back of the wearer through the epaulet 130 over the right shoulder of the wearer and downwardly along the chest into a pocket 132 on the front outer surface 25 of the garment 12. The pocket 132 extends upwardly from the waist of the wearer to approximately mid-chest or below and is configured to house the karabiner 112 and a folded up section of the lanyard 110. The pocket 132 extends to the waistline in order to lower the supporting point of the weight of the karabiner 112 for the comfort of the wearer. In the illustrated embodiment, the karabiner is constructed of aluminum for weight reduction. Other types of locking connectors may also be utilized. A similar pocket 132 is positioned on the left side of the front surface 25 in the event the wearer would prefer the weight of the karabiner to be on his left side. An epaulet may also be positioned on the left shoulder in the event it is desired to run the lanyard 110 over the left shoulder of the wearer.

As can be seen, only one metal component, i.e., the karabiner 106, is exposed on the outer surface of the coverall 12 thereby minimizing the danger of electrical contact. The shock absorber 108 is housed in a position that does not interfere with the worker nor present an unreasonable safety risk for entanglement with machinery, etc. The lanyard 110 is held against the coverall by the epaulet 130 to also reduce the risk of entanglement. The lanyard 110 and karabiner 112 are easily accessible to the wearer for connection to an anchorage point. Thus, the shock absorber may be connected at all times to the strap assembly without inconvenience or discomfort to the worker and without danger of entanglement, yet the shock absorber is readily accessible for connection to an anchorage point when needed.

In an optional configuration, a chest strap 136 may be utilized to connect strap 38 of loop section 36 to strap 40 of loop section 32. The strap 136 is connected and disconnected by a buckle assembly 138. Although the safety suit of the present invention is believed to fully meet Occupational Safety and Health Administration (OSHA) requirements, the optional chest strap 136 may be necessary to ensure compliance with Canadian Standards Association (CSA) and certain American National Standard Institute (ANSI) testing procedures. Without the chest strap 136, the safety suit 10 would entail no hardware except for the shock absorber assembly. The shock absorber assembly is easily removed for washing of the safety suit 10 and the absence of hardware protects the washing machine against damage during washing.

In use, the sleeve sections 96–104 allow the wearer to easily don the safety suit without entanglement in the strap assembly and precise positioning of the strap assembly relative to the wearer's body is achieved without adjustment. Maintaining the strap assembly in the proper position relative to the wearer's body is necessary to insure that the strap assembly is tightened around the desired portion of the body for proper force distribution. The strap assembly remains loosely fitted around the wearer during normal use so as to be comfortable and not interfere with the wearer's work function.

In the event the wearer encounters a fall hazard situation, the karabiner 112 and lanyard 110 are removed from the pocket 132 and the karabiner is attached to an anchorage such as a rope grab on a lifeline or a fixed anchorage point. In the event of a fall, the application of fall arresting force through the shock absorber to the connector loop 82 causes the strap assembly to automatically adjust and tighten around the body of the wearer. That is, the fall-arresting force applied to the connector loop 82 tightens the strap assembly about the thighs, pelvis, back and chest of the wearer to properly distribute fall arresting forces to the predetermined portions of the body. During automatic adjustment, the straps 38, 40 easily move through the respective slots 52,50 of the loops 30, 34 around the thighs of the wearer and through the slots of the back pad 28 to smoothly adjust to the proper position for safe distribution of fall-arresting force.

In manufacturing the safety suit of the present invention, the coverall garment 12 is assembled from flat pieces or sections that are sewn together. In the method of assembly of the present invention, the sleeve sections 96–104 are sewn to the flat pieces "on the flat" before they are assembled and sewn together to form the garment. After the flat pieces are sewn together to form the coverall garment, the straps 38, 40 are routed through the sleeve sections and joined together by stitching patterns at stitch areas 42, 44, 46, 48. Attaching the sleeve sections on the flat reduces the cost and time of manufacture. Since the sleeve sections do not cross any seams, any flexibility that has been designed into the coverall garment for washing purposes or otherwise are not compromised by attachment of the sleeve sections.

As can be appreciated from the foregoing, a new and improved safety suit has been described which provides fall protection for vertical free fall hazards. The suit is comfortable and loose to wear during normal working conditions and is automatically self-adjusting upon the occurrence of a fall to distribute fall-arresting forces to predetermined parts of the body to prevent injury. The suit is also lightweight and minimizes or eliminates buckles, hardware and exterior strapping to achieve both safety and comfort. The suit is self-adjusting so as to fit the wearer correctly without wearer adjustment with buckles or the like. Moreover, the safety suit is refined in appearance.

As will be apparent to persons skilled in the art, various modifications and adaptations of the structure above described will become readily apparent without departure from the spirit and scope of the invention, the scope of which is defined in the appended claims.

What is claimed is:

1. A fall-protection safety suit comprising a coverall having legs, arms and torso sections, and an inner and outer surface;

a strap assembly mounted within said coverall and configured for distributing fall-arresting forces to predetermined portions of a wearer's body, said strap assembly having a connector portion for connection to a shock absorber, said connector portion being positioned at the outer surface of said coverall approximately mid-back no lower than between shoulder blades of a wearer;

an elongated shock absorber connected to said connector portion of said strap assembly and adapted for interconnection to an anchorage; and said coverall having an elongated pocket on the outer surface housing said shock absorber and being positioned at approximately lower mid-back of a wearer.

2. The device of claim 1 wherein said shock absorber has first and second ends, said first end having first and second connector sections, said first connector section being connected to said connector portion of said strap assembly and said second connector section being connected to a lanyard adapted for connection to an anchorage.

3. The device of said claim 2 wherein said pocket has an open end and a closed end and said shock absorber is housed within said pocket such that said first end of said shock absorber is positioned at said open end.

4. The device of claim 1 wherein said pocket has an open upper end and a closed lower end.

5. A fall protection safety suit comprising a coverall having legs, arms and torso sections, an inner surface and an outer surface; and a strap assembly mounted within said coverall and having a connection portion for interconnection to an anchorage;

said strap assembly being configured for automatic adjustment from a first loose-fitting position about a wearer to a second fall-protect position about the wearer responsive to a fall-arresting force;

said strap assembly in said second position being tight-fitting about the wearer and positioned to distribute fall-arresting forces to shoulders, pelvis, thighs and vertically along the chest of the wearer;

said strap assembly comprising:

a back pad secured to said inner surface of said coverall approximately mid-back no lower than between shoulder blades of a wearer, first and second straps connected and positioned to form first, second, third and fourth loop sections, said first loop section extending about the right thigh of a wearer, said second loop section extending from said back pad, over the right shoulder and along the chest to said first loop section and from said first loop section along the back to said back pad, said third loop section extending about the left thigh of the wearer, said fourth loop section extending from said back pad, over the left shoulder and along the chest to said second loop section and from said second loop section along the back to said back pad, and said first and second straps being slidably mounted to said back pad to permit movement of said first and second straps during automatic adjustment from said first position to said second position.

6. The device of claim 5 wherein said first strap is a single piece of strap material and said second strap is a single piece of strap material.

7. The device of claim 6 wherein said first strap is joined to said second strap by no more than four stitch areas.

8. The device of claim 5 wherein said first and second straps are joined together proximate to said first loop section to form a first slot therebetween with said first strap extending through said first slot so as to be drawable through said first slot to tighten said first loop section about said right thigh and said first and second straps are joined together proximate to said second loop section to form a second slot therebetween with said second strap extending through said second slot so as to be drawable through said second slot to tighten said second loop section about said left thigh.

9. The device of claim 5 wherein said back pad has first and second oppositely disposed slots and third and fourth oppositely disposed slots, said first strap extending through said first and second slots across said back pad, said second strap extending through said third and fourth slots across said back pad, and said first strap being drawable through said first and second slots and said second strap being drawable through said third and fourth slots to permit automatic adjustment of said strap assembly from said first position to said second position.

10. The device of claim 9 wherein said back pad has fifth and sixth slots parallel and adjacent said first and second slots respectively and seventh and eighth slots parallel and adjacent said third and fourth slots respectively, said first strap extending through said fifth and sixth slots across said back pad, said second strap extending through said seventh and eighth slots across said back pad, and said first strap being drawable through said fifth and sixth slots and said second strap being drawable through said seventh and eighth slots to permit automatic adjustment of said strap assembly from said first position to said second position.

11. The device of claim 9 wherein said first strap crosses said second strap at said back pad to define an intersection of said first and second straps, said intersection forming a connector loop for detachable connection of a shock absorber to said strap assembly, and said coverall having an aperture therethrough and said connector loop extending through said aperture for accessibility at the outer surface of said coverall.

12. The device of claim 9 wherein said back pad is generally flat and constructed of soft, pliable material.

13. A fall protection safety suit comprising a coverall having legs, arms and torso sections, an inner surface and an outer surface; and a strap assembly mounted within said coverall and having a connection portion for interconnection to an anchorage;

said strap assembly being configured for automatic adjustment from a first loose-fitting position about a wearer to a second fall-protect,position about the wearer responsive to a fall-arresting force;

said strap assembly in said second position being tight-fitting about the wearer and positioned to distribute fall-arresting forces to shoulders, pelvis, thighs and vertically along the chest of the wearer;

said strap assembly having a connector portion for connection to a shock absorber, said connector portion being positioned at the outer surface of said coverall approximately mid-back no lower than between shoulder blades of a wearer;

an elongated shock absorber connected to said connector portion of said strap assembly and adapted for interconnection to an anchorage; and said coverall having an elongated pocket on the outer surface housing said shock absorber and being positioned at approximately lower mid-back of a wearer.

14. The device of claim 13 wherein said shock absorber has first and second ends, said first end having first and second connector sections, said first connector section being connected to said connector portion of said strap assembly and said second connector section being connected to a lanyard adapted for connection to an anchorage.

15. The device of claim 14 wherein said pocket has an open end and a closed end and said shock absorber is housed within said pocket such that said first end of said shock absorber is positioned at said open end.

16. The device of claim 15 wherein said pocket has an open upper end and a closed lower end.

* * * * *